US006745746B1

(12) United States Patent
Ishii

(10) Patent No.: US 6,745,746 B1
(45) Date of Patent: Jun. 8, 2004

(54) INTERNAL COMBUSTION ENGINE

(76) Inventor: Yoshiyuki Ishii, 1-4-23 Koenji Minami Suginami-ku, Tokyo (JP), 166-0003

( * ) Notice: Subject to any disclaimer, the term of this patent is extended or adjusted under 35 U.S.C. 154(b) by 39 days.

(21) Appl. No.: 10/194,640

(22) Filed: Jul. 12, 2002

(51) Int. Cl.[7] ..... F02B 75/02
(52) U.S. Cl. ..... 123/316; 123/197.4
(58) Field of Search ..... 123/197.4, 197.1, 123/53.1, 197.3, 51 BB, 53.5, 316

(56) References Cited

U.S. PATENT DOCUMENTS

| | | | | |
|---|---|---|---|---|
| 1,956,804 A | | 5/1934 | Meyer | |
| 4,945,866 A | * | 8/1990 | Chabot, Jr. | 123/53.1 |
| 5,816,201 A | * | 10/1998 | Garvin | 123/53.1 |

FOREIGN PATENT DOCUMENTS

WO WO 200149974 A1 * 7/2001 ..... F01B/9/02

OTHER PUBLICATIONS

Crouse, Automotive Engines, Eighth Edition, 1995, pp102, Left column 12th line from the bottom—Right column 5th line, Fig. 10–30.

Taylor, The Internal Combustion Engine in Theory and Practice vol. 1, Revised Edition, 1985, pp114, 3rd line—5th line.

Taylor, The Internal Combustion Engine in Theory and Practice vol. 2, Revised Edition, 1985, pp61, 14th line—12th line from the bottom.

Taylor, The Internal Combustion Engine in Theory and Practice vol. 2, Revised Edition, 1985, pp268, Equation (8–50).

Taylor, The Internal Combustion Engine in Theory and Practice vol. 2, Revised Edition, 1985, pp25, 3rd line.

* cited by examiner

*Primary Examiner*—Tony M. Argenbright
*Assistant Examiner*—Hyder Ali

(57) ABSTRACT

An internal combustion engine, which has poppet type valve overlap and timing means and has the centerline of each and every cylinder being offset from the rotational axis of the crankshaft in the counter direction of rotation, provides efficient transformation of combustion energy to mechanical rotational power reducing exhaust loss, heat loss and detonation, and increasing volumetric efficiency. The engine also increases effective torque at certain rotational angle of an early stage of a power stroke. Thereby, the invented engine improves thermal efficiency.

3 Claims, 8 Drawing Sheets

INTERNAL COMBUSTION ENGINE

CROSS-REFERENCE TO RELATED APPLICATIONS

Not applicable

STATEMENT REGARDING FEDERALLY SPONSORED RESEARCH AND DEVELOPMENT

Not applicable

BACKGROUND OF THE INVENTION

1. Field of the Invention

The present invention relates to an internal combustion engine which provides improved thermal efficiency.

2. Description of Prior Art

A modern internal combustion engine has a high performance of output power. Volumetric efficiency is one of the most important elements of the performance. The modern internal combustion engine has such unique valve overlap and timing to increase the volumetric efficiency as described by Crouse, Automotive Engines, Eighth Edition, 1995, pp 102. The modern engine takes the following an inlet-valve and outlet-valve operation:

1) The inlet-valve starts to open before an upper dead point of a piston and starts to close after a lower dead point of the piston in an intake-stroke.
2) The outlet-valve starts to open before the lower dead point and starts to close after the upper dead point of the piston in an exhaust stroke.

However, in view of thermal efficiency the modern combustion engine still needs improvements. It is the reason why there is always an appreciable loss (in the modern engine) due to the fact that the exhaust valve starts to open at a point before bottom center as described by Taylor, The Internal Combustion Engine in Theory and Practice, Volume 1: Thermodynamics, Fluid Flow, Performance, Second Edition 1985, pp 114.

To solve this problem the invented engine has an offset-cylinder and the closest structure of my invention is claim 1 of U.S. Pat. No. 1,956,804 which is patented on May 1, 1934 to A. J. Meyer.

However, neither valve nor means of valve overlap and timing are described in his claim 1. His claim 2 relates to opposed tendency of a piston to slap, but it does not relate to thermal efficiency. His claim 3 refers to detailed alignment of cylinders. His claim 4 describes the structure of sleeve valve type engine with offset-cylinder. His claim 5 describes opposed tendency for the pistons to slap against sleeve valve means.

Claims in Patent of Meyer does not refer to poppet-valve overlap and timing means which is one of the most important elements of the modern combustion engine.

BRIEF SUMMARY OF THE INVENTION

My research is focused on improvement of the modern engine caused by the poppet-valve overlap and timing, and especially on reduction of exhaust loss cased by the open timing of the outlet-valve of the modern engine.

Combining the modern combustion engine which has poppet-valve overlap and timing means with old prior art structure (U.S. Pat. No. 1,956,804), the invented engine has an offset cylinder to counter direction of a crankshaft rotation. The invented engine ends a power stroke faster or a piston moves faster in the power stroke, then reduces exhaust loss caused by the outlet-valve open timing and improves the thermal efficiency. For the exact calculation of the torque of the invented engine, theoretical formulae are developed and it is further found that the invented engine increases torque and volumetric efficiency, and reduces heat loss, detonation and time loss. The reduction of the detonation of the invented engine enables the more advanced spark timing approximately from 0 to 5 degrees than the prior art of the modern engine. Thereby, the invented engine totally improves the thermal efficiency.

LIST OF REFERENCE NUMERALS

Figure 3:
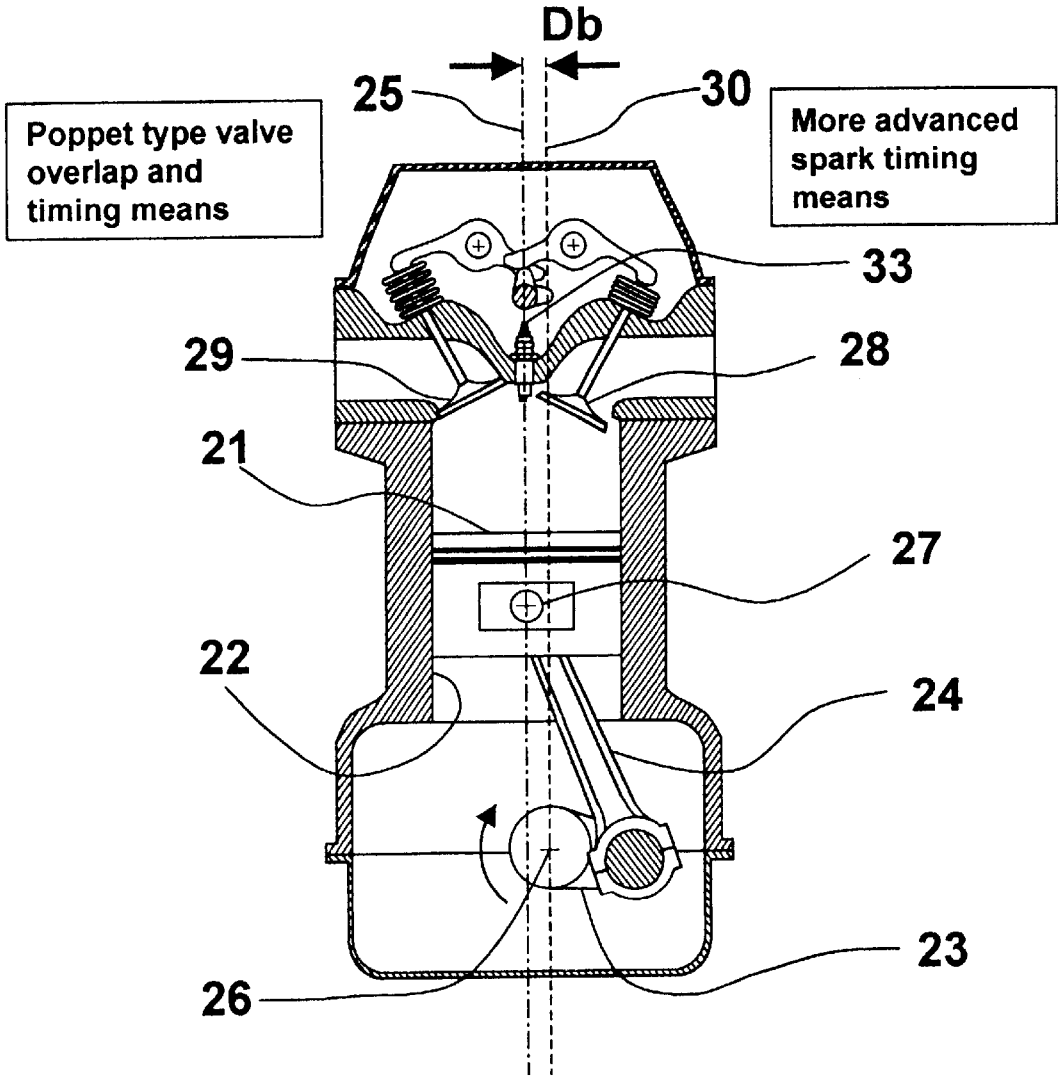
FIG. 3 is a simplified schematic representation of the engine of my present invention.
Figure 4:
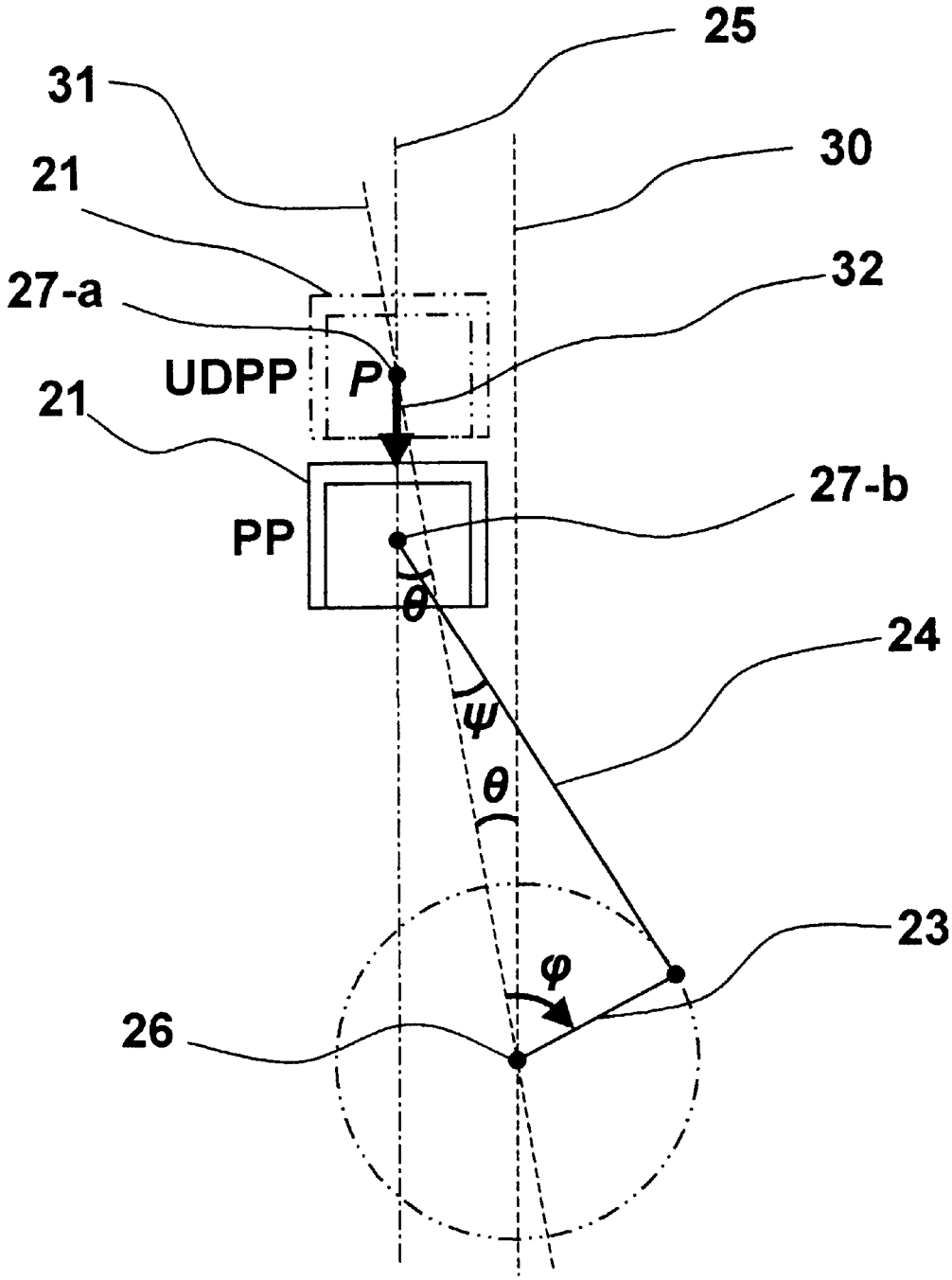
FIG. 4 is a schematic diagrammatic representation of the invented engine of FIG. 3 for the purpose of torque calculation.
Figure 5:
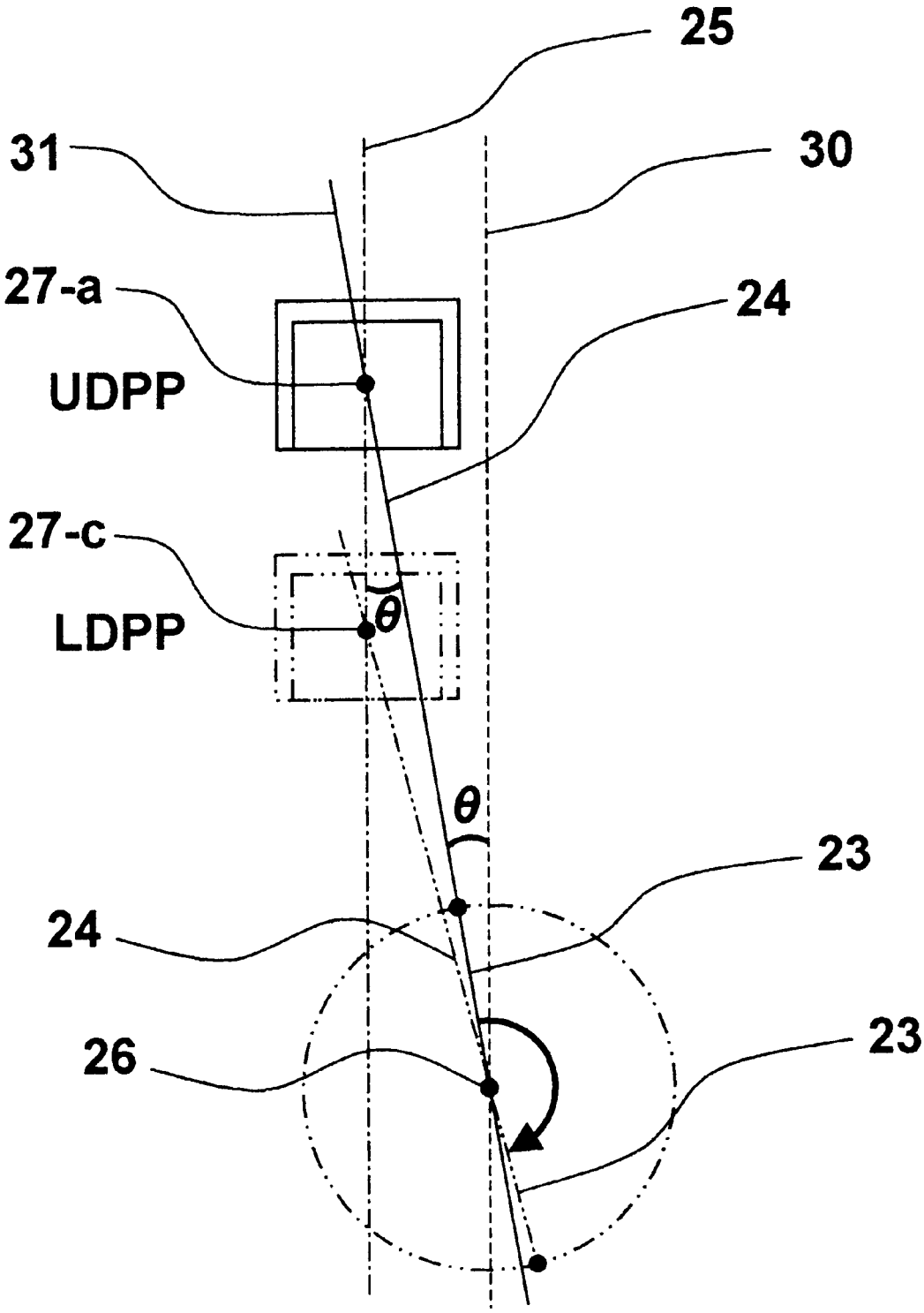
FIG. 5 is a schematic diagrammatic representation of FIG. 3 for the purpose of normalization of a piston stroke.

11 Piston (in FIG. 1)
12 Cylinder (in FIG. 1)
13 Crank (in FIG. 1)
14 Connecting rod (in FIG. 1)
15 Cylinder centerline (in FIG. 1)
16 Crankshaft rotational axis (in FIG. 1)
17 Piston pin (in FIG. 1)
18 Poppet type inlet-valve (in FIG. 1)
19 Poppet type outlet-valve (in FIG. 1)
20 Spark plug (in FIG. 1)
21 Piston (in FIG. 3 and 4)
22 Cylinder (in FIG. 3)
23 Crank (in FIG. 3, 4, and 5)
24 Connecting rod (in FIG. 3, 4 and 5)
25 Cylinder centerline (in FIG. 3, 4, and 5)
26 Crankshaft rotational axis (in FIG. 3, 4, and 5)
27 Piston pin (in FIG. 3)
27-*a* Upper dead point of piston pin (in FIG. 4 and 5)
27-*b* Point of piston pin (in FIG. 4)
27-*c* Lower dead point of piston pin (in FIG. 5)
28 Poppet type inlet-valve (in FIG. 3)
29 Poppet type outlet-valve (in FIG. 3)
30 Plane parallel to cylinder centerline 25 and on crankshaft rotational axis 26 (in FIG. 3, 4, and 5)
31 Line passing through upper dead point of piston pin 27-*a* and crankshaft rotational axis 26 (in FIG. 4 and 5)

32 Pressure P on piston head (in FIG. 4)
33 Spark plug (in FIG. 3)

DETAILED DESCRIPTION OF THE INVENTION

Overview

Figure 1:
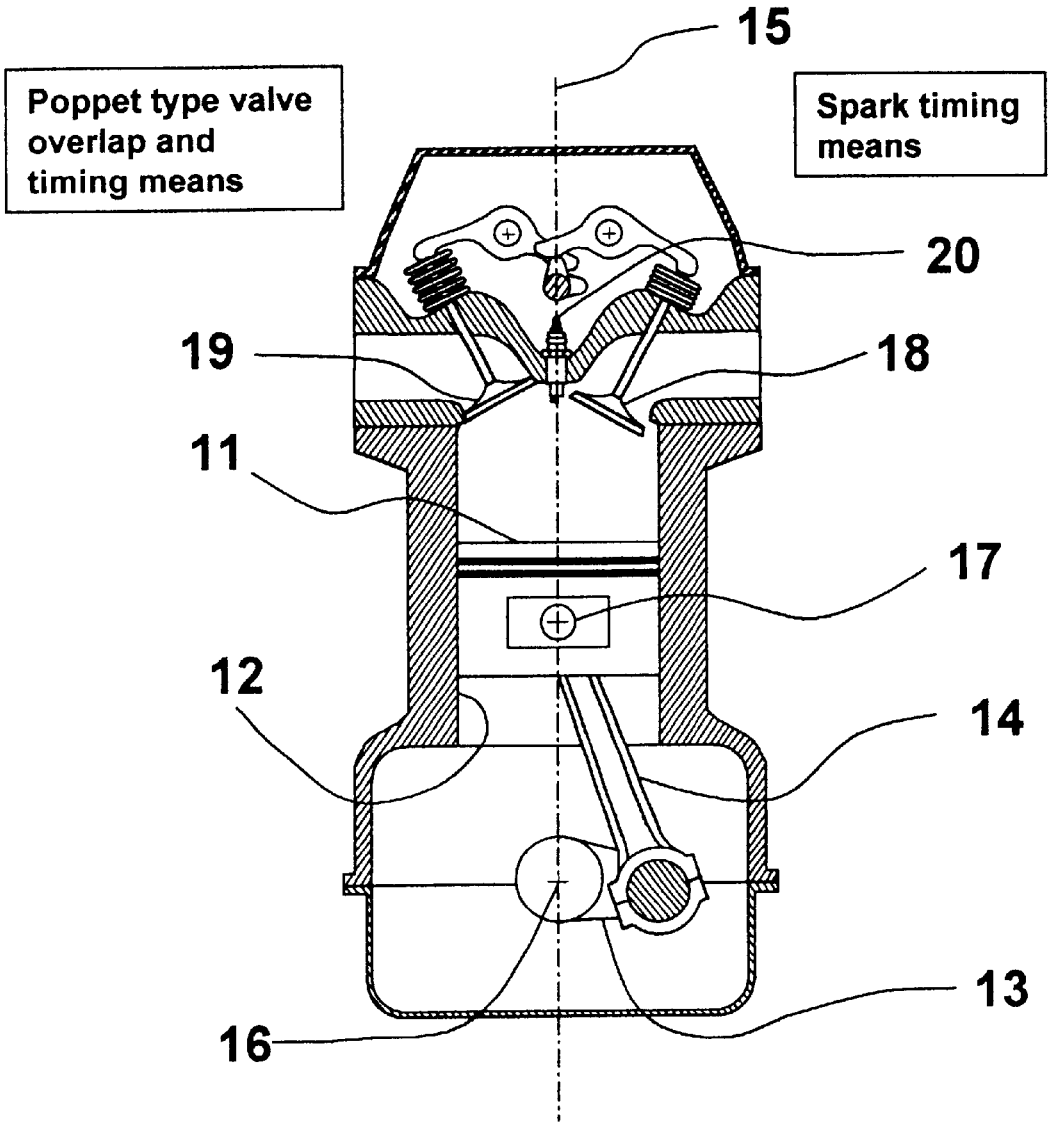
FIG. 1 (Prior Art)
FIG. 1 is a simplified schematic representation of the modern engine.

FIG. 1 shows a simplified schematic representation of prior art (the modern internal combustion engine) comprising, in pertinent part, a piston 11, a cylinder 12 of the block, a crank 13, a connecting rod 14, a piston pin 17, a poppet type inlet-valve 18, a poppet type outlet valve 19, and a spark plug 20. As shown, a cylinder centerline 15 of piston 11 and cylinder 12 intersects a crankshaft rotational axis 16. In order to increase the output power, the modern engine has spark timing means. It is denoted as spark timing means in a box of FIG. 1. In order to increase the volumetric efficiency, the modern engine has the valve overlap between the poppet type inlet-valve and the poppet type outlet-valve and the valve timing. They are denoted as poppet type valve overlap and timing means in a box of FIG. 1. The angle of the valve overlap and timing of the modern engine takes wide-rage of angle values.

Figure 2:
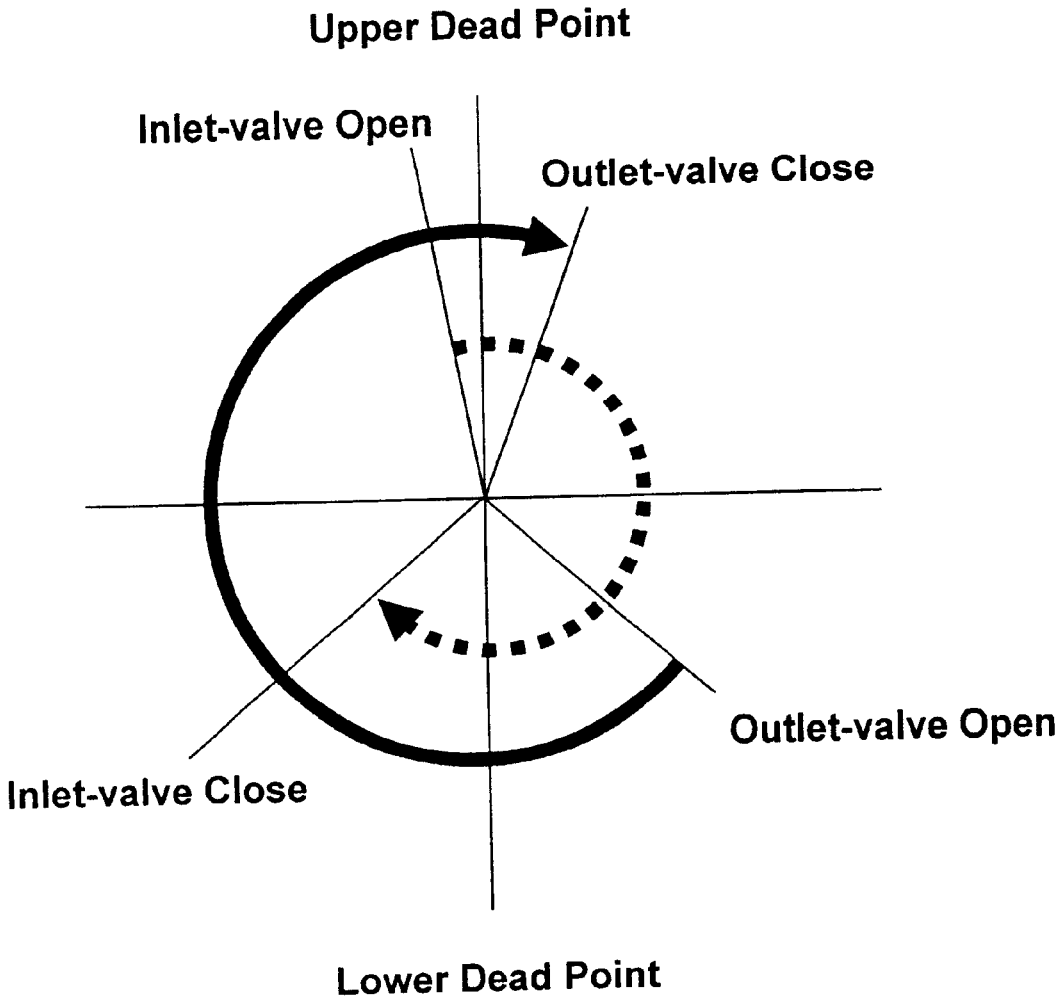
FIG. 2 (Prior Art)
FIG. 2 is an intake- and outlet-valve timing diagram of the modern engine.

FIG. 2 shows an intake- and outlet-valve timing diagram of the modern engine described by Crouse, Automotive Engines, Eighth Edition, 1995, pp 102. The typical inlet-value opening angle is 12 degrees before the upper dead point and the typical closing angle is 56 degrees after the lower dead point in the intake-stroke. The outlet-valve typically opens at 47 degrees before the lower dead point and closes at 21 degree after the upper dead point in the exhaust stroke. This gives more time for exhaust gases to leave the cylinder. The typical valve overlap angle is 33 degrees. The valve overlap helps scavenge the remaining exhaust gas and increase the volumetric efficiency.

It is known that there is always an appreciable loss (in the modern engine) due to the fact that the exhaust valve starts to open at a point before bottom center as described by Taylor, The Internal Combustion Engine in Theory and Practice, Volume 1: Thermodynamics, Fluid Flow, Performance, Second Edition 1985, pp 114.

It is also known that the tendency to detonate is promoted by an increase in end-gas temperature (by adiabatic pressure increase) and reduced by a reduction in time as by Taylor, The Internal Combustion Engine in Theory and Practice, Volume 2: Combustion, Fuels, Materials, Design, Revised Edition 1985, pp 61.

Combining the modern combustion engine with old prior art structure that is U.S. Pat. No. 1,956,804, the invented engine satisfies the following items 1) through 3):

1) the invented engine ends the exhaust stroke slower or the piston moves slower in exhaust stroke followed by the intake stroke,
2) the invented engine ends the power stroke faster or the piston moves faster in power stroke followed by the exhaust stroke, and
3) the invented engine ends the compression stroke slower or the piston moves slower in the compression stroke followed by the combustion stroke.

Thereby the invented engine improves the demerits of the modern engine.

Structure of the Invented Engine

FIG. 3 shows a simplified schematic representation of my present invented engine, which incorporates an offset-cylinder. The invented engine comprises, in pertinent part, a plane 30 parallel to a cylinder centerline 25 and on a crankshaft rotational axis 26 which is fixed in the invented engine, a piston 21 which reciprocates within a cylinder 22 of the block, a crank 23 which is fixedly attached to a crankshaft, a connecting rod 24, a piston pin 27, a poppet type inlet-valve 28, a poppet type outlet-valve 29, and a spark plug 33. For the purpose to use reduced detonation, the invented engine has more advanced spark timing means approximately from 0 to 5 degrees than the modern engine. It is denoted as more advanced spark timing means in a box of FIG. 3. For the volumetric efficiency and scavenging, the invented engine has the poppet type valve overlap and timing means between the poppet type inlet-valve and the poppet type outlet-valve. This is shown as poppet type valve overlap and timing means in a box of FIG. 3. As shown, cylinder centerline 25 has an offset to the counter rotational direction of the crankshaft. Piston 21 is operably connected to the crankshaft via piston pin 27, connecting rod 24, and crank 23, and the combustion power is transferred to rotational power of the crankshaft. The cylinder centerline offset from crankshaft rotational axis 26 is denoted "Db" in FIG. 3.

In FIG. 3 the piston moves satisfying the above modification items 1) through 3). Therefore, the invented engine overcomes the demerits of the modern engine and reduces losses.

Torque of the Invented Engine

FIG. 4 shows a simplified schematic diagrammatic representation of the invented engine of FIG. 3 for the calculation of torque. More specifically, FIG. 4 shows that piston 21 is moved from an upper dead point and the piston pin is moved from an upper dead point of the piston pin (UDPP) 27-*a* to a point of the piston pin (PP) 27-*b*. A line 31 passes through point 27-*a* and crankshaft rotational axis 26 in FIG. 4.

Assuming that x is the distance from point 27-*a* to point 27-*b*, a is the length of crank 23, l is the length of connecting rod 24, θ is the angle between line 31 and cylinder centerline 25, ϕ is the angle between crank 23 and line 31, and ψ is the angle between connecting rod 24 and line 31, the following equations (1) and (2) are obtained by trigonometry;

$$a+l=x\cos\theta+l\cos\psi+a\cos\phi \quad (1)$$

$$x\sin\theta=l\sin\psi-a\sin\phi \quad (2)$$

The equation (1) is equal to the following equation (1)';

$$x\cos\theta=a+l-l\cos\psi-a\cos\phi \quad (1)'$$

The following equations (3) is obtained by the equations (1)' and (2);

$$\tan\theta=\frac{-(a\sin\varphi-l\sin\psi)}{a+l-l\cos\psi-a\cos\varphi} \quad (3)$$

The following equation (4) is equal to the equation (3);

$$(a+l)\tan\theta-l\tan\theta\cos\psi-a\tan\theta\cos\phi=-(a\sin\phi-l\sin\psi) \quad (4)$$

The following equation (5) is obtained by multiplying cosθ to the equation (4);

$$\sin(\theta+\psi)=\frac{a+l}{l}\sin\theta-\frac{a}{l}\sin(\theta-\varphi) \tag{5}$$

The following equation (6) is obtained by applying trigonometry to the equation (5);

$$\cos(\theta+\psi)=\sqrt{1-(\sin(\theta+\psi))^2}=\frac{1}{l}\sqrt{l^2-[(a+l)\sin\theta-a\sin(\theta-\varphi)]^2} \tag{6}$$

The following equation (7) is obtained by differentiating the equation (4) with respect to $\phi$ and multiplying $\cos\theta$ to the differentiated equation;

$$d\psi=d\varphi\frac{a}{l}\cdot\frac{\cos(\theta-\varphi)}{\cos(\theta+\psi)} \tag{7}$$

The following equation (8) is obtained by the equations (5), (6) and (7);

$$d\psi=d\varphi\frac{a}{l}\cdot\frac{\cos(\theta-\varphi)}{\sqrt{1-(\sin(\theta+\psi))^2}}=d\varphi\cdot a\cdot\frac{\cos(\theta-\varphi)}{\sqrt{l^2-[(a+l)\sin\theta-a\sin(\theta-\varphi)]^2}} \tag{8}$$

The following equation (9) is obtained by differentiating the equation (2);

$$\frac{d}{dx}(a+l)=\frac{d}{dx}(x\cos\theta+l\cos\psi+a\cos\varphi) \tag{9}$$

The following equation (10) is equal to the equation (9);

$$dx=\frac{1}{\cos\theta}[l\cdot\{\sin(\psi+\theta)\cos\theta-\cos(\psi+\theta)\sin\theta\}d\psi+a\cdot\sin\varphi\cdot d\varphi] \tag{10}$$

The following equation (11) is obtained by the equations (5), (6), (8) and (10);

$$dx=a\cdot\left[-\frac{\sin\theta\cos(\theta-\varphi)-\sin\varphi}{\cos\theta}+\frac{\cos(\theta-\varphi)((a+l)\sin\theta-a\sin(\theta-\varphi))}{\sqrt{l^2-[(a+l)\sin\theta-a\sin(\theta-\varphi)]^2}}\right]\cdot d\varphi \tag{11}$$

In FIG. 4 a pressure denoted "P" 32 is transmitted through piston 21, connecting rod 24 and crank 23 to the crankshaft rotation. Assuming that T is the instantaneous torque, T is calculated by the following equation as described by Taylor, The Internal Combustion Engine in Theory and Practice Vol. 2, Revised edition, 1985, pp 268;

$$T=F\cdot\left(\frac{dx}{d\varphi}\right)$$

The following equation (12) is obtained by the equation (11);

$$T=F\cdot a\cdot\left[-\frac{\sin\theta\cos(\theta-\varphi)-\sin\varphi}{\cos\theta}+\frac{\cos(\theta-\varphi)((a+l)\sin\theta-a\sin(\theta-\varphi))}{\sqrt{l^2-[(a+l)\sin\theta-a\sin(\theta-\varphi)]^2}}\right] \tag{12}$$

Figure 6:
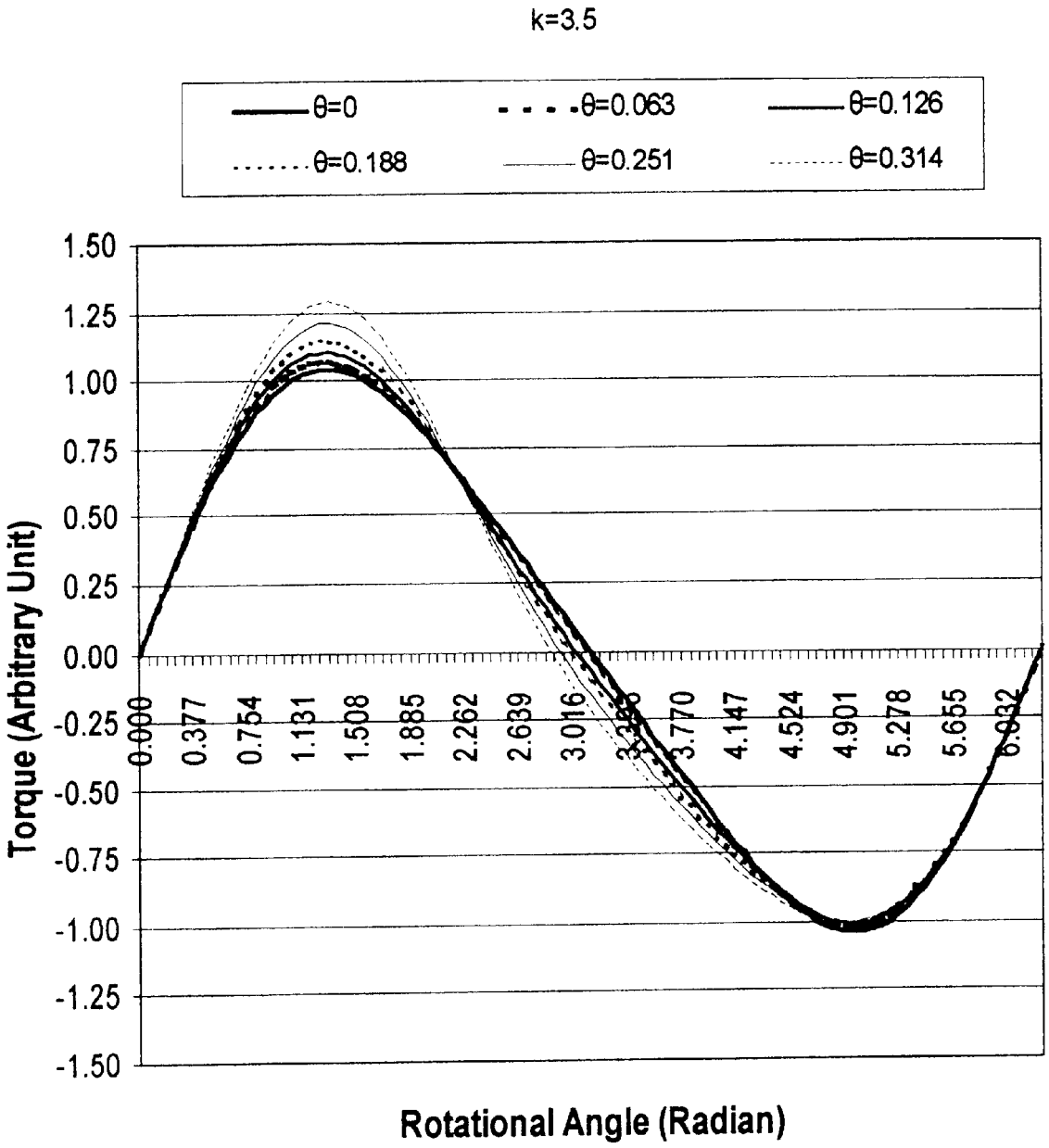
FIG. 6 is a graphical representation of calculated torque of the invented engine under constant pressure.

Assuming that bore size=2, P=1/π, l=3.5 and θ is set for 0 (no-offset-cylinder engine), 0.063(radian), 0.126(radian), 0.188(radian), 0.251(radian) and 0.314(radian), series of the torque are calculated by the equation (12). The calculated torque is shown graphically in FIG. 6. The result explains that the torque of the invented engine is bigger than that of the modern no-offset-cylinder engine at smaller rotational angle than about 2.0 (radian), and is smaller than that of the modern no-offset-cylinder engine at larger rotational angle than about 2.0 (radian). It means that the invented engine effectively transforms the high combustion pressure to the mechanical torque in the actual power stroke because the equation (12) is applicable to any value of pressure.

However, this comparison is insufficient because the stroke of the invented engine is longer than that of the modern no-offset-cylinder engine.

It is necessary for sufficient comparison that the invented engine has not only the same bore but also the same stroke as the modern engine has because the bore and the stroke decide the total amount of the intake which is a substantial parameter of an engine.

Assuming that L is the stroke of the invented engine which is equal to the distance from UDPP 27-*a* to LDPP 27-*c*, a is the radius of crank 23, l is the length of connecting rod 24, θ is the angle between centerline 25 and line 31 in FIG. 5, the following equation (13) is obtained by applying the second cosine rule of trigonometry to the triangle composed of UDPP 27-*a*, LDPP 27-*c* and rotational axis 26 in FIG. 5;

$$(l-a)^2=L^2+(l+a)^2-2L(l+a)\cos\theta \tag{13}$$

Ratio l/a is one of basic parameters of engine design and k is defined as follows;

$$k=\frac{l}{a}$$

Then, the equation (13) is equal to the following equation (13)';

$$(ak-a)^2=L^2+(a+ak)^2-2L(ak+a)\cos\theta \tag{13}$$

L is solved as the following equation (14);

$$L=a(k+1)\cos\theta\pm\sqrt{(a(k+1))^2\cos^2\theta-4a^2k} \tag{14}$$

L should be less than l (=ak), then L is equal to the following equation (15);

$$L=a(k+1)\cos\theta-\sqrt{(a(k+1))^2\cos^2\theta-4a^2k} \tag{15}$$

Assuming that the invented engine has the stroke 2b, the following equation (16) is obtained;

$$2b=a(k+1)\cos\theta-\sqrt{(a(k+1))^2\cos^2\theta-4a^2k} \tag{16}$$

a is solved as the following equation (17);

$$a = \frac{b(k+1)\cos\theta \pm \sqrt{(b(k+1)\cos\theta)^2 - 4kb^2}}{2k} \tag{17}$$

Adopting physically meaningful solution, a is solved as the following equation (17)';

$$a = \frac{b(k+1)\cos\theta + \sqrt{(b(k+1)\cos\theta)^2 - 4kb^2}}{2k} \tag{17'}$$

Assuming that b=1, k=3.5, and θ is set for 0 (no-offset-cylinder), 0.063, 0.126, 0.188, 0.251 and 0.314(radian), corresponding crank radius to each θ is calculated by the equation (17)' and the result is shown in the TABLE 1.

TABLE 1

| | θ = 0 | θ = 0.063 | θ = 0.126 | θ = 0.188 | θ = 0.251 | θ = 0.314 (radian) |
|---|---|---|---|---|---|---|
| Crank Radius a | 1.0000 | 0.9964 | 0.9857 | 0.9679 | 0.9422 | 0.9083 |

Substituting the crank radius values and the angle values into the equation (12), series of the torque normalized with the piston stroke are calculated under the constant pressure of 1/π (arbitrary unit).

Figure 7:
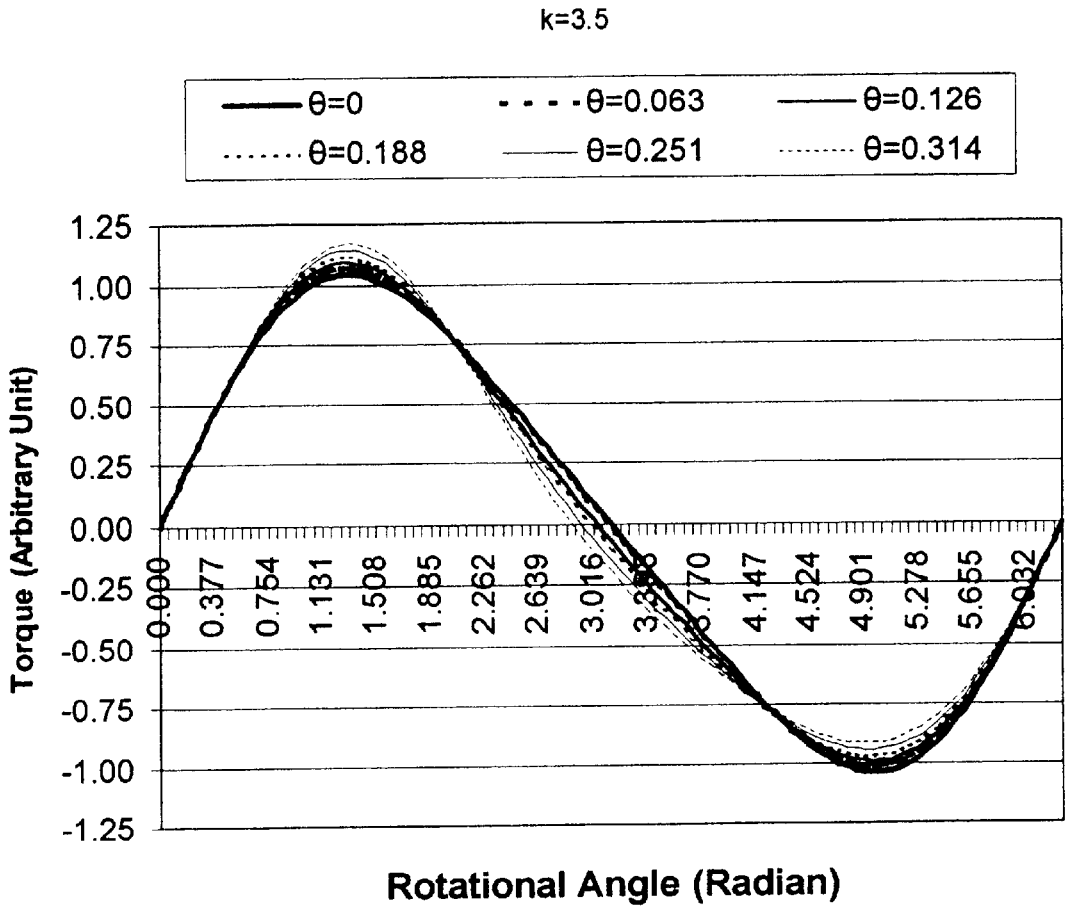
FIG. 7 is a graphical representation of torque of the invented engine normalized with the piston stroke of the invented engine under constant pressure.

FIG. 7 shows the calculated results graphically. Under the normalized stroke, the invented engine gains the torque and the torque value of the invented engine is bigger than that of the modern no-offset-cylinder engine approximately at the angle from 0 to 2.0 (radian).

The comparison assumes the constant pressure but the equation (12) is applicable to any value of pressure. In the actual power stroke, the pressure varies and the peak pressure angle is usually selected from about 15 degrees (0.26 radian) to about 25 degrees (0.43 radian) and the pressure usually becomes a half at about 0.9 (radian).

The invented engine efficiently uses the combustion energy at an early stage of the power stroke, and improves thereby the thermal efficiency.

Work Done at Small Rotational Angle in Power Stroke of the Invented Engine

Substituting l=ak to the equation (12) then, the following equation (18) is obtained;

$$T = F \cdot a \cdot \left[ -\frac{\sin\theta\cos(\theta-\varphi) - \sin\varphi}{\cos\theta} + \frac{\cos(\theta-\varphi)\,((k+1)\sin\theta - \sin(\theta-\varphi))}{\sqrt{k^2 - [(k+1)\sin\theta - \sin(\theta-\varphi)]^2}} \right] \tag{18}$$

The work done to the piston by the pressure in FIG. 4 is obtained by integrating the equation (18).

It is important to get bigger torque nearly at such the optimum crank angle (15 to 20 degrees ATC) of the modern no-offset-cylinder engine as described by Taylor, The Internal Combustion Engine in Theory and Practice, Volume 2: Combustion, Fuels, Materials, Design, Revised Edition 1985, pp 25.

Practically, the high combustion pressure region is in the angle ϕ between 10 degrees and 30 degrees (between 0.17 radian and 0.52 radian).

The numerical integration of the equation (18) is made with respect to the rotational angle ϕ from 9.90 (approximately=15−5) degrees to 24.9 (approximately=20+5) degrees, and also done from 9.90 degrees to 30.0 degrees, for k=3.0, 3.5, 4.0, 4.5 and 5.0, and for θ=0, 0.063, 0.126, 0.188, 0.251 and 0.314 (radian). The calculated results are shown in TABLE 2.

TABLE 2

| | Integration to | | Work Done from 0.172 radian (9.9 degrees) | | | | | |
|---|---|---|---|---|---|---|---|---|
| k | Radian | Degree | θ = 0 | θ = 0.063 | θ = 0.126 | θ = 0.188 | θ = 0.251 | θ = 0.314 |
| 3.0 | 0.435 | 24.9 | 0.10367 | 0.10452 | 0.10489 | 0.10501 | 0.10450 | 0.10329 |
| | 0.524 | 30.0 | 0.15721 | 0.15876 | 0.15975 | 0.16009 | 0.15966 | 0.15818 |
| 3.5 | 0.435 | 24.9 | 0.10007 | 0.10078 | 0.10120 | 0.10128 | 0.10099 | 0.10020 |
| | 0.524 | 30.0 | 0.15182 | 0.15311 | 0.15397 | 0.15435 | 0.15417 | 0.15327 |
| 4.0 | 0.435 | 24.9 | 0.09738 | 0.09799 | 0.09836 | 0.09847 | 0.09828 | 0.09772 |
| | 0.524 | 30.0 | 0.14779 | 0.14890 | 0.14966 | 0.15003 | 0.14997 | 0.14936 |
| 4.5 | 0.435 | 24.9 | 0.09639 | 0.09693 | 0.09726 | 0.09738 | 0.09725 | 0.09681 |
| | 0.524 | 30.0 | 0.14577 | 0.14674 | 0.14741 | 0.14776 | 0.14776 | 0.14732 |
| 5.0 | 0.435 | 24.9 | 0.09471 | 0.09519 | 0.09549 | 0.09560 | 0.09551 | 0.09517 |
| | 0.524 | 30.0 | 0.14327 | 0.14412 | 0.14473 | 0.14506 | 0.14509 | 0.14476 |

The work done ratio is calculated for the purpose of the comprehensive comparison with the modern no-offset-cylinder engine (θ=0). The results are shown in TABLE 3.

Figure 8:
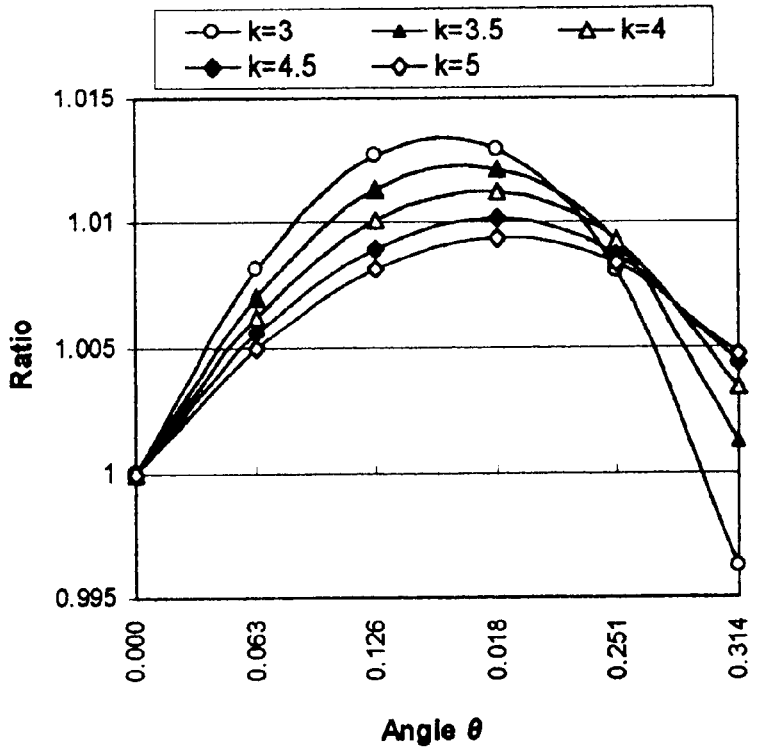
FIG. 8 is a graphical representation of the work done ratio of the invented engine to the modern no-offset-cylinder engine from 9.9 degrees to 24.9 degrees of the crankshaft rotational angle.
Figure 9:
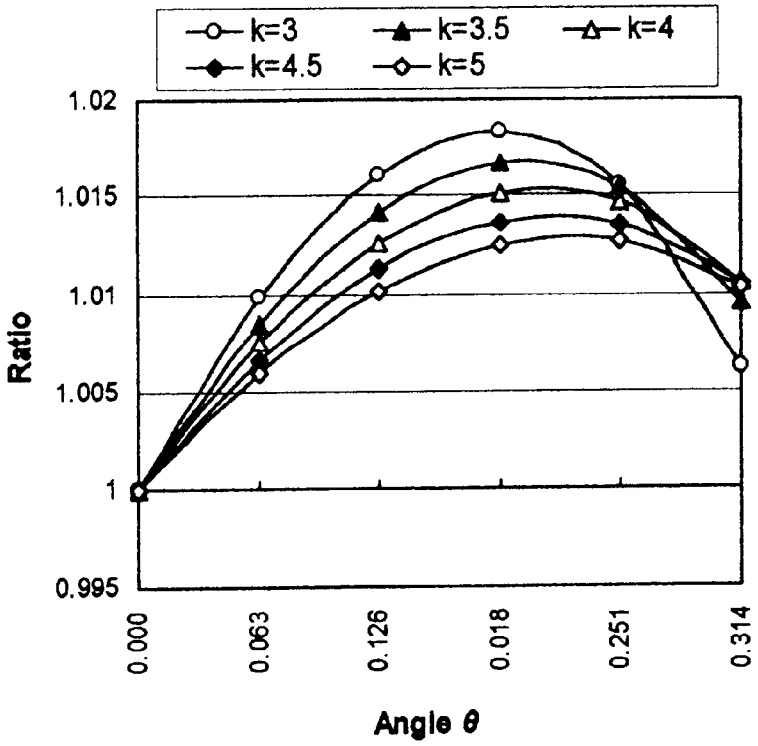
FIG. 9 is a graphical representation of the work done ratio of the invented engine to the modem no-offset-cylinder engine from 9.9 degrees to 30.0 degrees of the crankshaft rotational angle.

FIG. 8 and FIG. 9 graphically represent Table 3. FIG. 8 shows the work done ratio of the invented engine to the modern no-offset-cylinder engine, where the torque is integrated from 0.172 radian (9.9 degree) to 0.435 radian (24.9 degree).

FIG. 9 shows the work done ratio of the invented engine to the modern no-offset-cylinder engine, where the torque is integrated from 0.172 radian (9.9 degree) to 0.524 radian (30.0 degree).

FIG. 8 and 9 explain that;

(1) series of the biggest ratio is obtained by the angle between θ=0.126 radian and θ=0.251 radian for k=3.0, 3.5, 4.0, 4.5 and 5.0, and (2) the ratio is bigger than 1.0 even at small angle of θ=0.030 radian.

Taking account of the above investigation the invented engine produces more output power than the modern engine in the early stage of the combustion stroke. The invented engine thereby improves the thermal efficiency.

TABLE 3

| | Rotational Angle | | Work done ratio to the modern no-offset-cylinder engine (θ = 0) | | | | |
|---|---|---|---|---|---|---|---|
| k | Radian | Degree | θ = 0.063 | θ = 0.126 | θ = 0.188 | θ = 0.251 | θ = 0.314 |
| 3.0 | 0.435 | 24.9 | 1.0082 | 1.0127 | 1.0129 | 1.0081 | 0.9963 |
| | 0.524 | 30.0 | 1.0099 | 1.0161 | 1.0183 | 1.0156 | 1.0062 |
| 3.5 | 0.435 | 24.9 | 1.0071 | 1.0113 | 1.0121 | 1.0092 | 1.0013 |
| | 0.524 | 30.0 | 1.0085 | 1.0142 | 1.0167 | 1.0155 | 1.0096 |
| 4.0 | 0.435 | 24.9 | 1.0063 | 1.0101 | 1.0112 | 1.0093 | 1.0035 |
| | 0.524 | 30.0 | 1.0075 | 1.0126 | 1.0151 | 1.0147 | 1.0106 |
| 4.5 | 0.435 | 24.9 | 1.0056 | 1.0090 | 1.0102 | 1.0088 | 1.0044 |
| | 0.524 | 30.0 | 1.0066 | 1.0113 | 1.0137 | 1.0136 | 1.0106 |
| 5.0 | 0.435 | 24.9 | 1.0050 | 1.0082 | 1.0094 | 1.0084 | 1.0048 |
| | 0.524 | 30.0 | 1.0060 | 1.0102 | 1.0125 | 1.0127 | 1.0104 |

Db is the distance from crankshaft rotational axis 26 to cylinder centerline 25 in FIG. 3. Db is calculated by the following equation (19):

$$Db=(l+a)\sin\theta=a(k+1)\sin\theta \tag{19}$$

The following equation (19)' is obtained by using equations (13) and (19);

$$Db=\sqrt{(l+a)^2-\left(\frac{L^2+4la}{2L}\right)^2} \tag{19'}$$

Piston Speed of the Invented Engine

Assuming that the invented engine rotates at constant speed (φ=ωt), then the piston speed is obtained by the following equation (20);

$$\frac{dx}{dt}=\left(\frac{dx}{d\varphi}\right)\cdot\left(\frac{d\varphi}{dt}\right)=\left(\frac{dx}{d\varphi}\right)\cdot\omega \tag{20}$$

The following equation (21) is obtained by the equations (11), (12) and (20);

$$\frac{dx}{dt}=\omega\cdot a\cdot\left[-\frac{\sin\theta\sin(\theta-\varphi)-\sin\varphi}{\cos\theta}+\frac{\cos(\theta-\varphi)\cdot((k+1)\sin\theta-\sin(\theta-\varphi))}{\sqrt{k^2-[(k+1)\sin\theta-\sin(\theta-\varphi)]^2}}\right] \tag{21}$$

For comprehensive comparison between the invented engine and the modern engine, assuming that one up and down stroke time is 1 and a normalized stroke with the modern no-offset-cylinder engine is 2, the piston distance from upper dead point is calculated by integrating the equation (21).

TABLE 4 shows the typical positions of the piston normalized with an up and down stroke time=1 and TABLE 4 is numerically calculated for k=3.0, and θ=0, 0.063, 0.126, 0.188, 0.251 and 0.314(radian).

TABLE 5, 6, 7, and 8 also show the results numerically calculated for k=3.5, 4.0, 4.5, and 5.0 respectively.

TABLE 4

| | | Rotational Angle | | Piston distance from upper dead point | | | | | |
|---|---|---|---|---|---|---|---|---|---|
| k | Time | Radian | Degree | θ = 0 | θ = 0.063 | θ = 0.126 | θ = 0.188 | θ = 0.251 | θ = 0.314 |
| 3.0 | 0 | 0 | 0 | 0 | 0 | 0 | 0 | 0 | 0 |
| | 0.444 | 2.7897 | 159.84 | 1.95933 | 1.97234 | 1.98316 | 1.99164 | 1.99767 | 1.99999 |
| | 0.457 | 2.8714 | 164.52 | 1.97618 | 1.98596 | 1.99337 | 1.99819 | 2.00000 | 1.99732 |
| | 0.469 | 2.9468 | 168.84 | 1.98774 | 1.99445 | 1.99862 | 1.99999 | 1.99789 | 1.99064 |
| | 0.479 | 3.0096 | 172.44 | 1.99446 | 1.99855 | 2.00000 | 1.99849 | 1.99314 | 1.98214 |
| | 0.490 | 3.0788 | 176.40 | 1.99881 | 1.99999 | 1.99842 | 1.99376 | 1.98488 | 1.96986 |
| | 0.500 | 3.1416 | 180.00 | 1.99999 | 1.99853 | 1.99423 | 1.98672 | 1.97471 | 1.95616 |
| | 1 | 6.2832 | 360.00 | 0 | 0 | 0 | 0 | 0 | 0 |

TABLE 5

| | | Rotational Angle | | Piston distance from upper dead point | | | | | |
|---|---|---|---|---|---|---|---|---|---|
| k | Time | Radian | Degree | θ = 0 | θ = 0.063 | θ = 0.126 | θ = 0.188 | θ = 0.251 | θ = 0.314 |
| 3.5 | 0 | 0 | 0 | 0 | 0 | 0 | 0 | 0 | 0 |
| | 0.456 | 2.8651 | 164.16 | 1.97330 | 1.98209 | 1.98929 | 1.99480 | 1.99859 | 2.00000 |
| | 0.466 | 2.9280 | 167.76 | 1.98417 | 1.99079 | 1.99573 | 1.99886 | 2.00000 | 1.99837 |
| | 0.475 | 2.9845 | 171.00 | 1.99153 | 1.99616 | 1.99903 | 2.00000 | 1.99872 | 1.99436 |
| | 0.483 | 3.0348 | 173.88 | 1.99616 | 1.99899 | 2.00000 | 1.99903 | 1.99561 | 1.98884 |
| | 0.492 | 3.0913 | 177.12 | 1.99920 | 1.99999 | 1.99891 | 1.99576 | 1.98995 | 1.98050 |
| | 0.500 | 3.1416 | 180.00 | 1.99999 | 1.99897 | 1.99602 | 1.99095 | 1.98303 | 1.97124 |
| | 1 | 6.2832 | 360.00 | 0 | 0 | 0 | 0 | 0 | 0 |

TABLE 6

| | | Rotational Angle | | Piston distance from upper dead point | | | | | |
|---|---|---|---|---|---|---|---|---|---|
| k | Time | Radian | Degree | θ = 0 | θ = 0.063 | θ = 0.126 | θ = 0.188 | θ = 0.251 | θ = 0.314 |
| 4.0 | 0 | 0 | 0 | 0 | 0 | 0 | 0 | 0 | 0 |
| | 0.464 | 2.9154 | 167.04 | 1.98135 | 1.98764 | 1.99273 | 1.99657 | 1.99912 | 1.99999 |
| | 0.472 | 2.9657 | 169.92 | 1.98880 | 1.99356 | 1.99707 | 1.99925 | 1.99999 | 1.99884 |
| | 0.479 | 3.0096 | 172.44 | 1.99378 | 1.99717 | 1.99927 | 2.00000 | 1.99914 | 1.99621 |
| | 0.486 | 3.0536 | 174.96 | 1.99730 | 1.99931 | 2.00000 | 1.99926 | 1.99680 | 1.99210 |
| | 0.493 | 3.0976 | 177.48 | 1.99937 | 2.00000 | 1.99926 | 1.99706 | 1.99300 | 1.98654 |
| | 0.500 | 3.1416 | 180.00 | 1.99999 | 1.99923 | 1.99707 | 1.99341 | 1.98776 | 1.97955 |
| | 1 | 6.2832 | 360.00 | 0 | 0 | 0 | 0 | 0 | 0 |

TABLE 7

| | | Rotational Angle | | Piston distance from upper dead point | | | | | |
|---|---|---|---|---|---|---|---|---|---|
| k | Time | Radian | Degree | θ = 0 | θ = 0.063 | θ = 0.126 | θ = 0.188 | θ = 0.251 | θ = 0.314 |
| 4.5 | 0 | 0 | 0 | 0 | 0 | 0 | 0 | 0 | 0 |
| | 0.469 | 2.9468 | 168.84 | 1.98572 | 1.99054 | 1.99444 | 1.99735 | 1.99930 | 2.00000 |
| | 0.476 | 2.9908 | 171.36 | 1.99152 | 1.99514 | 1.99779 | 1.99944 | 2.00000 | 1.99917 |
| | 0.482 | 3.0285 | 173.52 | 1.99530 | 1.99787 | 1.99946 | 2.00000 | 1.99936 | 1.99722 |
| | 0.488 | 3.0662 | 175.68 | 1.99797 | 1.99949 | 2.00000 | 1.99943 | 1.99759 | 1.99414 |
| | 0.494 | 3.1039 | 177.84 | 1.99953 | 2.00000 | 1.99943 | 1.99775 | 1.99471 | 1.98994 |
| | 0.500 | 3.1416 | 180.00 | 1.99999 | 1.99940 | 1.99775 | 1.99497 | 1.99073 | 1.98466 |
| | 1 | 6.2832 | 360.00 | 0 | 0 | 0 | 0 | 0 | 0 |

TABLE 8

| | | Rotational Angle | | Piston distance from upper dead point | | | | | |
|---|---|---|---|---|---|---|---|---|---|
| k | Time | Radian | Degree | θ = 0 | θ = 0.063 | θ = 0.126 | θ = 0.188 | θ = 0.251 | θ = 0.314 |
| 5.0 | 0 | 0 | 0 | 0 | 0 | 0 | 0 | 0 | 0 |
| | 0.473 | 2.9719 | 170.28 | 1.98892 | 1.99269 | 1.99572 | 1.99798 | 1.99947 | 2.00000 |
| | 0.479 | 3.0096 | 172.44 | 1.99336 | 1.99620 | 1.99828 | 1.99956 | 2.00000 | 1.99937 |
| | 0.484 | 3.0411 | 174.24 | 1.99620 | 1.99826 | 1.99954 | 2.00000 | 1.99954 | 1.99795 |
| | 0.489 | 3.0725 | 176.04 | 1.99826 | 1.99952 | 2.00000 | 1.99963 | 1.99828 | 1.99572 |
| | 0.495 | 3.1102 | 178.20 | 1.99968 | 1.99999 | 1.99949 | 1.99814 | 1.99572 | 1.99200 |
| | 0.500 | 3.1416 | 180.00 | 1.99999 | 1.99951 | 1.99821 | 1.99602 | 1.99272 | 1.98803 |
| | 1 | 6.2832 | 360.00 | 0 | 0 | 0 | 0 | 0 | 0 |

The calculated results show that the invented engine ends the down stroke faster than the modern no-offset-cylinder engine, and increases the up stroke time.

In TABLE 4, for example, the modern no-offset-cylinder engine ends the down stroke at 50% of the total time of the up and down stroke or at the angle of 180 (degree), and uses the rest time or angle for the up stroke. The invented engine for θ=0.314 ends the down stoke at 44.4% of the total time of the up and down stoke, or at the angle of 159.84 (degree), and uses the reset time 55.6% of the total time, or the rest angle 200.16 (degree), for the up stroke.

Piston Speed and Heat Loss of the Invented Engine

Heat loss increases as time elapses after the combustion. It is more efficient to end the power stroke in shorter time at the same rotational speed because the heat loss is reduced. As shown in TABLE 4, 5, 6, 7, and 8, the invented engine ends the down stroke faster than the modern no-offset-cylinder engine and more efficiently uses the combustion energy than the modern no-offset-cylinder engine. The invented engine thereby improves the thermal efficiency.

Piston Speed and Exhaust Loss of the Invented Engine

It is known that there is always an appreciable loss (in the modern engine) due to the fact that the exhaust valve starts to open at a point before bottom center as described by Taylor, The Internal Combustion Engine in Theory and Practice, Volume 1: Thermodynamics, Fluid Flow, Performance, Second Edition 1985, pp 114.

A typical rotational angle of the exhaust valve-opening from the upper dead center is 133 degrees (or 2.32 radian) as shown by Crouse, Automotive Engines, 8th edition 1995, pp 102.

As shown in TABLE 4, 5, 6, 7, and 8, the invented engine ends the power stroke faster than the modern no-offset-cylinder engine. This characteristic allows the invented engine to open the exhaust valve at the angle less than π (radian) and reduces the exhaust loss caused by the exhaust valve-opening angle. The invented engine thereby improves the thermal efficiency.

When the power stroke ends at the angle 2.32 radian that is the typical angle of the exhaust valve-opening angle, the exhaust loss caused by the exhaust valve-opening angle is eliminated. The angle θ which determines the offset amount of the cylinder can basically be calculated by the equation (38) substituting dx/dt=0, ϕ=2.32(radian). The rotational angle ϕ is also numerically calculated by setting the piston distance from the upper dead point is equal to the stroke (L=2b=2). The results are shown in TABLE 9 for k=3.0, and θ=0.314, 0.337, 0.440 and 0.502 (radian). In Table 9, the power stroke ends at 2.3436 radian (=134.28 degree) for k=3, and the exhaust valve can open after this angle when θ is taken equal to 0.502 (radian). This particular result explains that the invented engine almost eliminates the exhaust loss caused by the exhaust valve-opening angle of the modern engine.

TABLE 9

| | Rotational Angle | | Piston distance from upper dead point | | | |
|---|---|---|---|---|---|---|
| k | Radian | Degree | θ = 0.314 | θ = 0.377 | θ = 0.440 | θ = 0.502 |
| 3.0 | 2.7897 | 159.84 | 1.99999 | — | — | — |
| | 2.6892 | 154.08 | — | 2.00000 | — | — |
| | 2.5573 | 146.52 | — | — | 2.00000 | — |
| | 2.3436 | 134.28 | — | — | — | 2.00000 |

Piston Speed and Volumetric Efficiency of the Invented Engine

As shown in TABLE 4, 5, 6, 7, and 8, the invented engine ends the down stroke earlier than the modern no-offset-cylinder engine. The characteristic increases the piston speed during the intake stroke. The invented engine gets higher volumetric efficiency even at low rotation speed than the modern engine. The characteristic allows the invented engine to have wider variety of engine design.

Piston Speed and Detonation of the Invented Engine

As shown in TABLE 4, 5, 6, 7, and 8, the piston speed of the invented engine in the compression stroke is slower than that of the modern engine. The invented engine looses more heat of the air-fuel mixture in the compression stroke than the modern engine.

It is known that the tendency to detonate is promoted by an increase in end-gas temperature (by adiabatic pressure increase) and reduced by a reduction in time as described by Taylor, The Internal Combustion Engine in Theory and Practice, Volume 2: Combustion, Fuels, Materials, Design, Revised Edition 1985, pp 61.

Therefore, the invented engine reduces the detonation and is capable of earlier ignition timing, which is approximately from 0 to 5 degrees, than the modern engine and reduction of time loss. The invented engine thereby improves the thermal efficiency.

Having thus described preferred and alternative embodiments of the present invention, what is claimed:

1. A method for increasing the thermal efficiency of an internal combustion engine comprising at least one cylinder and one piston reciprocating within each and every said cylinder providing each and every said piston with;

(a) a compression stroke and a power stroke having a fixed stroke length wherein the departing speed of each and every said piston from the upper dead point of said piston in said power stroke being higher than the approaching speed of each and every said piston to said upper dead point in said compression stroke followed by said power stroke, and (b) an exhaust stroke and an intake stroke having said fixed stroke length wherein the departing speed of each and every said piston from said upper dead point of said piston in said intake stroke being higher than the approaching speed of each and every said piston to said upper dead point in said exhaust stroke followed by said intake stroke, and comprising more advanced spark timing means in a manner that, in said compression stroke before said upper dead point, said more advanced spark timing means ignites from 0 to 5 degrees earlier than a conventional internal combustion engine does, whereby said internal combustion engine increases said thermal efficiency.

2. A method for increasing the thermal efficiency of an internal combustion engine comprising at least one cylinder having a centerline, one piston reciprocating within each and every said cylinder, at least one connecting rod, one crankshaft having a rotational axis fixed in said internal combustion engine, at least one crank extending in a direction perpendicular to said crankshaft fixedly attached to said crankshaft and each and every said piston operably connected to said crankshaft via said piston pin said connecting rod and said crank, providing each and every said piston with:

(a) a compression stroke and a power stroke having a fixed stroke length wherein the departing speed of each and every said piston from the upper dead point of said piston in said power stroke being higher than the approaching speed of each and every said piston to said upper dead point in said compression stroke followed by said power stroke, and (b) an exhaust stroke and an intake stroke having said fixed stroke length wherein the departing speed of each and every said piston from said upper dead point of said piston in said intake stroke being higher than the approaching speed of each and every said piston to said upper dead point in said exhaust stroke followed by said intake stroke, comprising more advanced spark timing means in a manner that in said compression stroke before said upper dead point, said more advanced spark timing means ignites from 0 to 5 degrees earlier than a conventional internal combustion engine does, comprising at least one poppet type inlet-valve and one poppet type outlet valve of each and every said cylinder, and comprising poppet type valve overlap and timing means in a manner that;

(a) said poppet type inlet-valve typically opens at 12 degrees before said upper dead point and typically closes at $$\left(146-\theta-\cos^{-1}\left(\frac{(l+a)\sin\theta}{l-a}\right)\right)$$

degree after said lower dead point in said intake stroke, (b) said poppet type outlet-valve typically opens at $$\left(\theta+\cos^{-1}\left(\frac{(l+a)\sin\theta}{l-a}\right)-43\right)$$

degree before said lower dead point and typically closes at 21 degrees after said upper dead point in said exhaust stroke where l is the length of said connecting rod, a is crank radius of said crank, θ is the angle between said centerline and the line which is on the vertical plane of said rotational axis of said crankshaft and passes through the upper dead point of said piston pin and said rotational axis of said crankshaft, whereby said internal combustion engine increases said thermal efficiency.

3. The internal combustion engine of claim 2 providing θ for 0.126 to 0.188 radian, whereby said internal combustion engine is configured in most efficient condition.

* * * * *